US007967004B2

(12) United States Patent
Inzaghi

(10) Patent No.: US 7,967,004 B2
(45) Date of Patent: Jun. 28, 2011

(54) MODULAR BURNER FOR A COOKING PLATE

(75) Inventor: Enzo Inzaghi, Treviso (IT)

(73) Assignee: Steel Time S.p.A., Chions-Frazione Villotta-Pordenone (IT)

( * ) Notice: Subject to any disclaimer, the term of this patent is extended or adjusted under 35 U.S.C. 154(b) by 225 days.

(21) Appl. No.: 12/225,086

(22) PCT Filed: Jan. 11, 2007

(86) PCT No.: PCT/EP2007/000371

§ 371 (c)(1),
(2), (4) Date: Oct. 15, 2008

(87) PCT Pub. No.: WO2007/107195

PCT Pub. Date: Sep. 27, 2007

(65) Prior Publication Data

US 2009/0101132 A1 Apr. 23, 2009

(30) Foreign Application Priority Data

Mar. 23, 2006 (IT) ..... MI2006A0535

(51) Int. Cl.
*F24C 15/10* (2006.01)

(52) U.S. Cl. ..... 126/39 K; 126/39 E; 126/39 H; 126/39 R; 126/214 C

(58) Field of Classification Search ..... 126/39 E, 126/39 H, 39 K, 39 R
See application file for complete search history.

(56) References Cited

U.S. PATENT DOCUMENTS

| | | | | | |
|---|---|---|---|---|---|
| 560,357 | A | * | 5/1896 | Kahn | 126/214 R |
| 1,355,933 | A | * | 10/1920 | Wilcox | 126/214 R |
| 1,649,007 | A | * | 11/1927 | Wilcox | 126/214 D |
| 1,889,548 | A | * | 11/1932 | Guay | 126/163 A |
| 1,931,517 | A | * | 10/1933 | Toelle | 126/39 N |
| 2,025,458 | A | * | 12/1935 | Klein | 239/553.3 |
| 2,029,449 | A | * | 2/1936 | Teller et al. | 126/41 E |
| 2,040,446 | A | * | 5/1936 | Schneider | 126/39 R |
| 2,100,292 | A | * | 11/1937 | Schneider | 126/39 H |
| 2,148,777 | A | * | 2/1939 | Schneider | 126/39 H |
| 2,255,349 | A | * | 9/1941 | Nunn | 431/347 |
| 2,257,399 | A | * | 9/1941 | Parker | 126/39 J |
| 2,300,156 | A | * | 10/1942 | Higley | 431/44 |
| 2,320,754 | A | * | 6/1943 | Sherman | 126/39 K |
| 2,337,095 | A | * | 12/1943 | Frick | 126/39 K |
| 2,402,429 | A | * | 6/1946 | Moecker, Jr et al. | 126/39 E |

(Continued)

FOREIGN PATENT DOCUMENTS

EP 0 676 591 A2 10/1995

(Continued)

OTHER PUBLICATIONS

PCT Search Report Dated Jul. 17, 2007.

*Primary Examiner* — Kenneth B Rinehart
*Assistant Examiner* — Jorge Pereiro
(74) *Attorney, Agent, or Firm* — Hedman & Costigan, P.C.; James V. Costigan

(57) ABSTRACT

A modular burner for a cooking plate of a cooking appliance comprises a burner base (20) in turn comprising a framework (22), a burner base (21) which can be centrally assembled to the framework (22) and at least one cover for covering the framework (22) and the burner base (21).

22 Claims, 12 Drawing Sheets

U.S. PATENT DOCUMENTS

| | | | | |
|---|---|---|---|---|
| 2,480,046 | A * | 8/1949 | Reeves | 126/39 R |
| 2,487,720 | A * | 11/1949 | Miller et al. | 126/113 |
| 2,498,289 | A * | 2/1950 | Moecker, Jr et al. | 431/194 |
| 2,506,483 | A * | 5/1950 | Bechtold | 126/39 H |
| 2,632,438 | A * | 3/1953 | Chambers | 126/214 C |
| 2,654,359 | A * | 10/1953 | Reeves | 126/39 K |
| 2,861,563 | A * | 11/1958 | Jensen | 126/214 C |
| 2,862,667 | A * | 12/1958 | Hillebrand | 236/32 |
| 3,202,203 | A * | 8/1965 | Reed | 431/207 |
| 4,313,416 | A * | 2/1982 | Lau | 126/39 E |
| 4,705,021 | A | 11/1987 | Beach | |
| 6,132,205 | A * | 10/2000 | Harneit | 431/354 |
| 6,325,619 | B2 * | 12/2001 | Dane | 431/284 |
| 6,672,302 | B1 * | 1/2004 | Voorhis et al. | 126/39 R |
| 7,322,820 | B2 * | 1/2008 | Welton et al. | 431/354 |
| 7,628,609 | B2 * | 12/2009 | Pryor et al. | 431/286 |
| 2003/0087214 | A1 * | 5/2003 | Welton et al. | 431/286 |
| 2006/0207588 | A1 * | 9/2006 | Staebler et al. | 126/215 |
| 2006/0236997 | A1 * | 10/2006 | Little et al. | 126/40 |
| 2007/0154858 | A1 * | 7/2007 | Cadima | 431/354 |
| 2008/0206697 | A1 * | 8/2008 | Trochou | 431/284 |
| 2009/0126715 | A1 * | 5/2009 | Grassi et al. | 126/39 R |
| 2010/0005976 | A1 * | 1/2010 | Inzaghi | 99/444 |

FOREIGN PATENT DOCUMENTS

| | | | |
|---|---|---|---|
| EP | 0 848 211 | A | 6/1998 |
| EP | 1531304 | A2 * | 5/2005 |
| WO | WO 2005/078342 | A | 8/2005 |
| WO | WO 2006/005428 | A | 1/2006 |
| WO | WO 2006/119798 | A | 11/2006 |

* cited by examiner

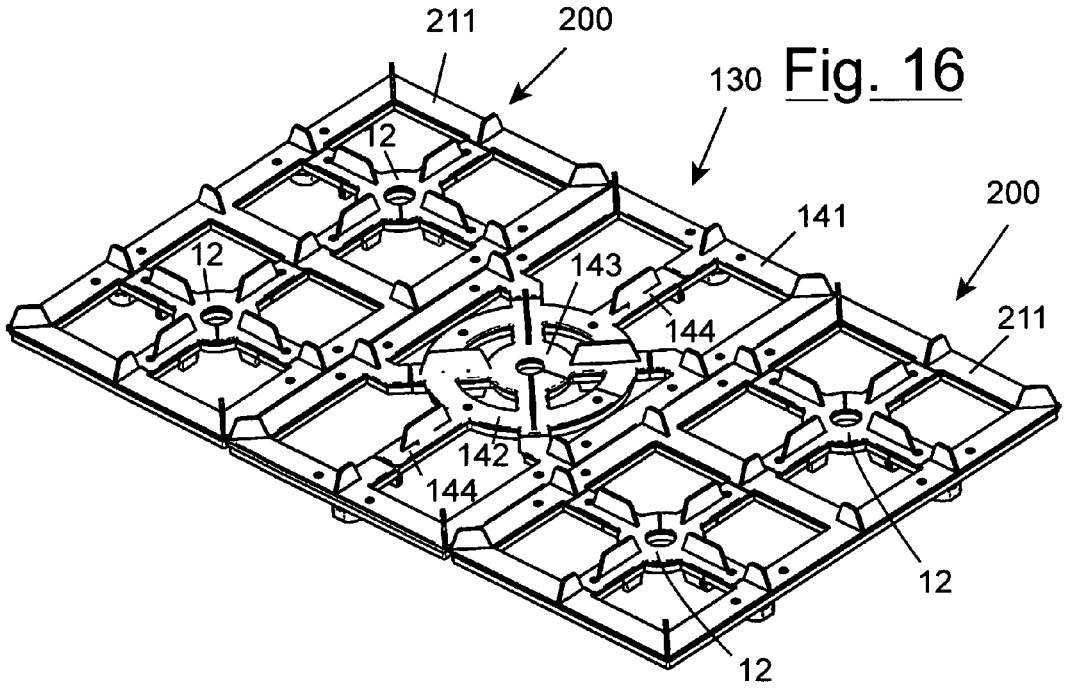
Fig. 16
Fig. 17
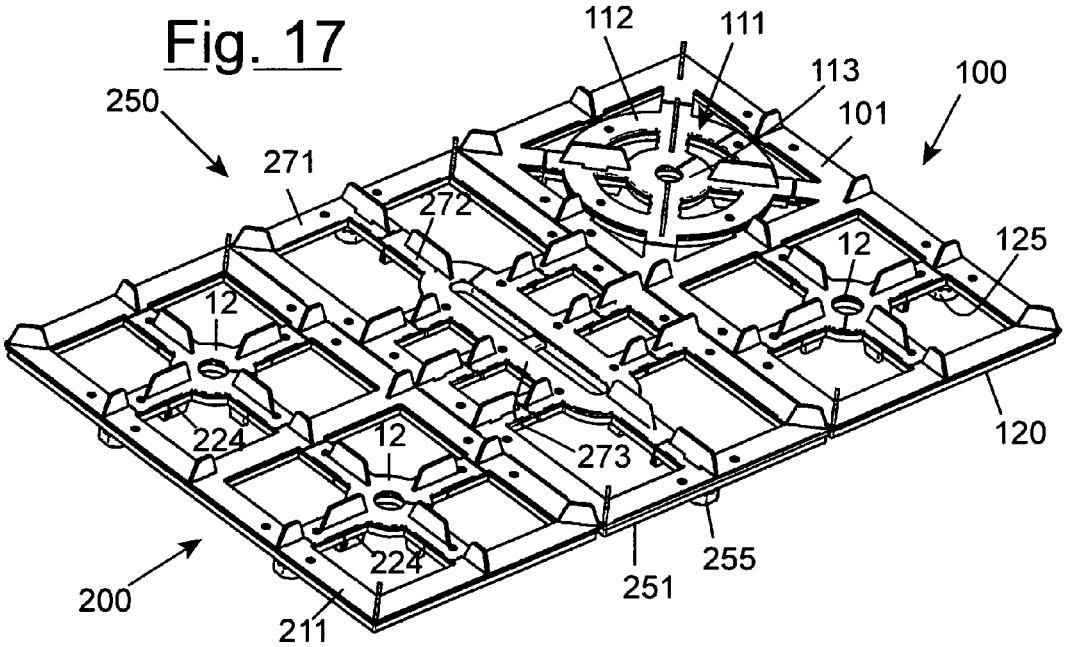

MODULAR BURNER FOR A COOKING PLATE

The present invention relates to a modular burner for a cooking plate.

The burner according to the invention is particularly but not exclusively destined for application to cooking tops such as those described and illustrated in patent application PCT/EP2005/011174 in the name of Inzaghi Enzo, said PCT should be considered as being an integrant part of the present patent application.

Cooking tops for stoves, having a series of burners situated in the centre of cooking plates and equipped with underlying basins suitable for collecting drips and food residues which overflow from cooking containers, have been known for some time.

These burners are generally produced with a circular shape and have a series of holes or notches along the circumference for the gas outlet, flame-dividers, through which the flame is distributed for heating the bottom of the container.

According to the known art therefore, both the plate and the basin have a central opening with relatively large dimensions, through which the burner passes, creating in this region an expansion bowl which is in turn covered by a cover equipped with flame-divider notches.

This configuration of the cooking plate according to the known art is not without drawbacks.

First of all, the cleaning of the burner can only be partial, mostly applied to the removable cover, and is difficult and approximate with respect to the expansion bowl.

The food drips can also occupy the spaces between the burner and the basin, also penetrating the latter, along the expansion bowl, which makes the cleaning of these elements lengthy and ineffective.

Possible maintenance or substitution of the elements relates to the cover and also the expansion bowl which, as they are the elements of the plate most subject to physical-chemical aggression, are more susceptible to damage.

Another drawback can be found in the limited possibility of correctly distributing the flame with a variation in the maximum heating capacity to be obtained in a burner. In this configuration, the maximum flame capacity is directly correlated to the diameter of the burner, upon increasing this diameter, however, a vaster flameless central region is created, jeopardizing the distribution uniformity of the flame under the container.

A general objective of the present invention is therefore to overcome the above disadvantages of the known art by providing a modular burner for cooking plates.

A particular objective of the present invention is to provide a modular burner which is easy to clean.

Further objectives of the present invention are to provide a cooking plate with a burner which can be easily removed and washed, resistant to the most critical conditions and modular for producing various forms of cooking tops.

In view of the above objectives, the concept of the present invention is to provide a modular burner for cooking plates, having the characteristics indicated in the enclosed claims.

The structural and functional characteristics of the present invention as also its advantages with respect to the known art will appear more evident from the following description, referring to the enclosed drawings which show a modular burner produced according to the innovative principles of the same invention.

Figure 13:
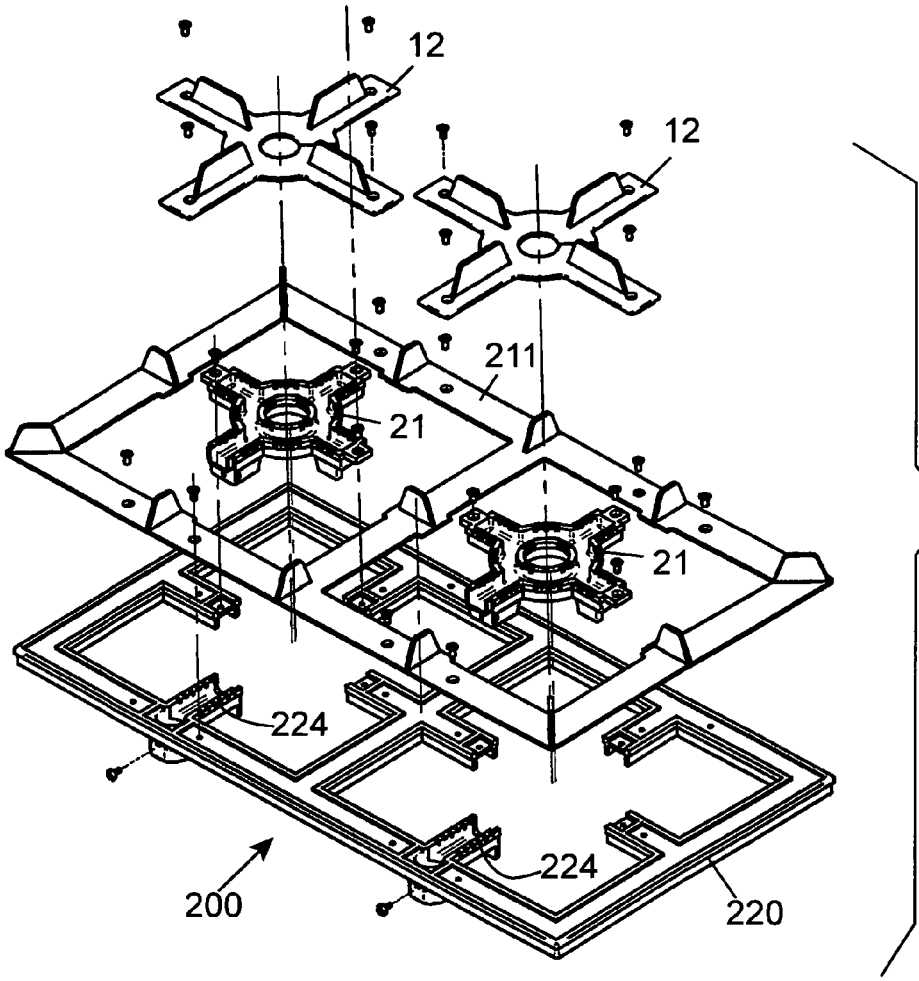
Figure 14:
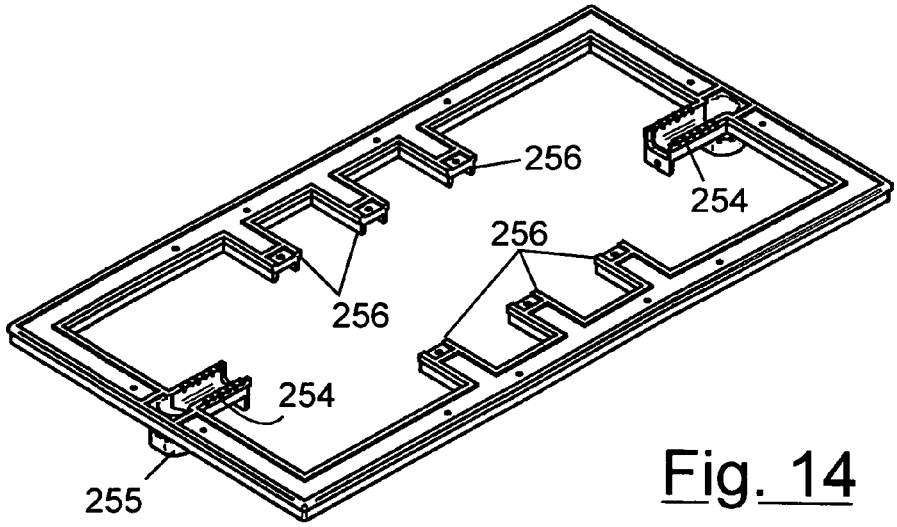
Figure 15:
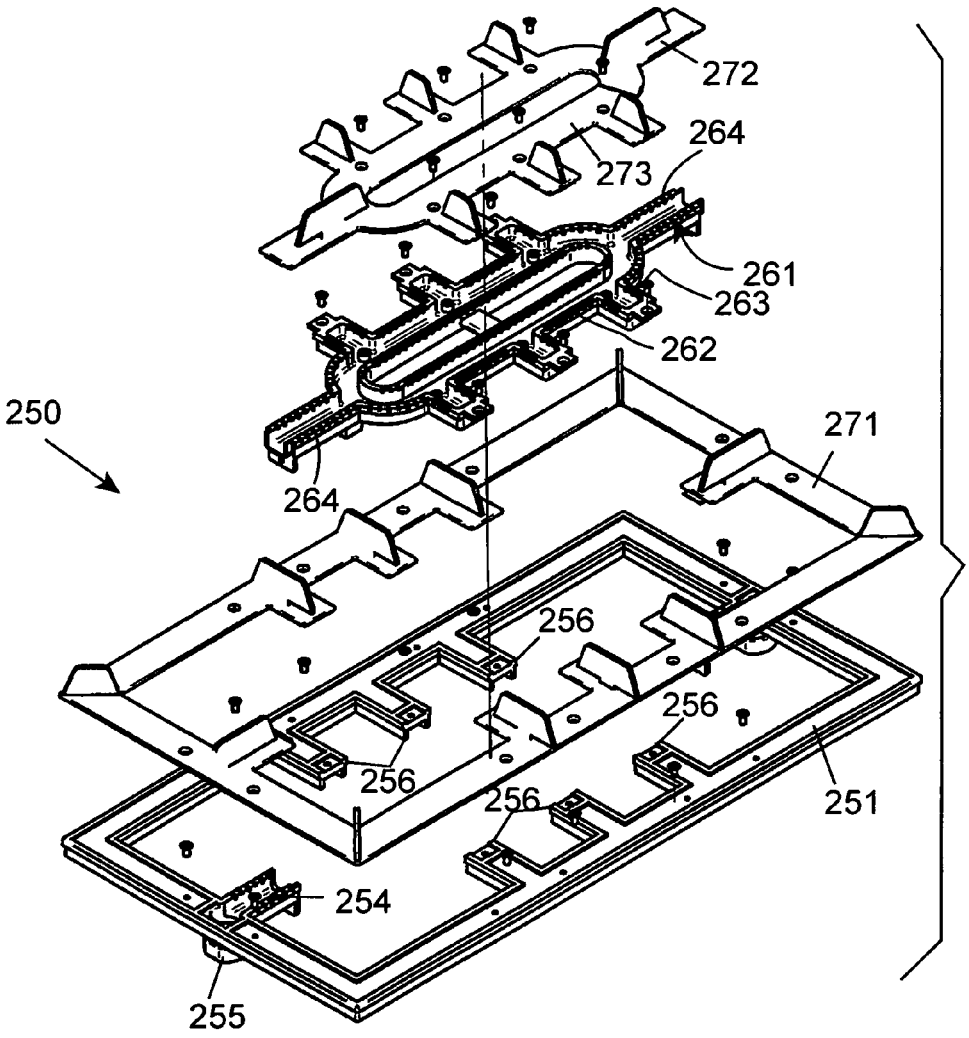
Figure 18:
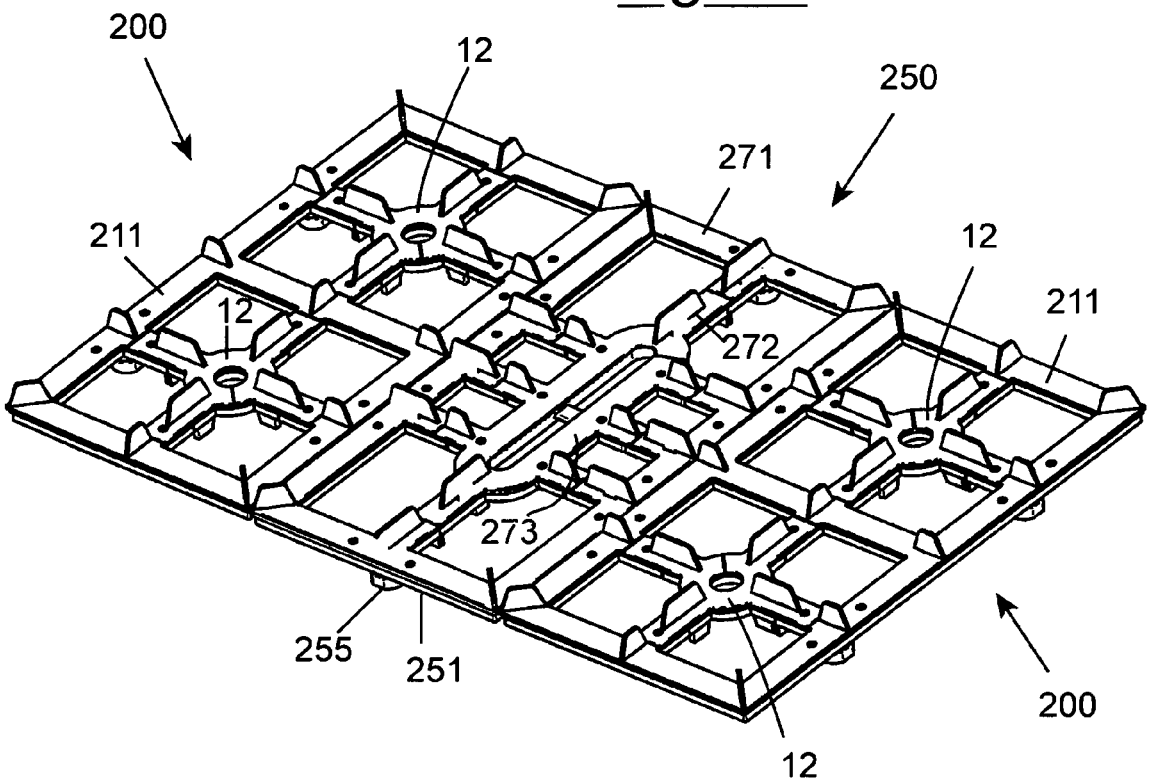

FIGS. 9-12 respectively illustrate a large-flame burner in an exploded perspective view, a base detail view, assembled in a perspective and plan view;

FIG. 13 is an exploded perspective view of a small-small double-flame burner;

FIG. 14 shows a perspective view of a base of an oblong burner for a fish pan;

FIG. 15 is an exploded perspective view of an oblong burner for a fish pan;

FIGS. 16-18 show a perspective view of other compositions of burners for a cooking plate.

With reference to the figures, a modular burner 10 destined for a cooking plate of a cooking appliance comprises a first burner base 20 in turn comprising a framework 22 non-limitingly illustrated as square-shaped, a second burner base 21 which can be centrally assembled with respect to the framework 22, at least one cover but preferably an outer cover 11 and an inner cover 12 separated and respectively destined for covering the framework 22 and the second burner base 21.

The framework comprises a series of supporting arms 23 which extend radially towards the centre thereof and a burner arm 24 fed by a connection 25 situated along the framework 22.

In the embodiment illustrated with a square framework, there are three supporting arms 23 leaving the centre of three sides of the framework and a burner arm 24 leaving the centre of the fourth side, the number and position of these however can differ.

The burner arm 24 is therefore "U"-shaped and is equipped with a channel 29' connected to the connection 25 for the feeding of the gas to the whole second burner base 21.

The burner arm 24 also has flame-divider notches 30 situated along the edge of the wings 35 of the "U" to allow the formation of the flame along this section.

At the end facing the inside of the framework, each supporting arm 23 has a seat 31 equipped with a hole 19 suitable for housing the corresponding ends of the burner second base 21 and allow it to be fixed by means of screws 15.

As the burner arm 24 has to allow the passage of gas along the channel 29', it has a lower bracket 38 suitable for being connected to a corresponding lower counter-element 37 extending from the second burner base 21.

The framework 22 is also equipped with further holes 19 for fixing the outer cover 11 and inner cover 12.

The second burner base 21 is equipped with radial channels 27 configured so as to correspond to the arms 23, 24 which support them and allow the circulation of gas fed by the channel 29' connected to the connection 25.

The second burner base 21 also comprises a crown 26 having a central aeration opening 28, the channels 27 extend radially from said crown.

Three of the channels 27 are each equipped at their free end with a bracket 32 with a hole 33 destined for one of the three arms 23.

The fourth channel 27 is arranged for being connected to the burner arm 24 and has a lower counter-element 37 for the purpose.

Both the crown 26 and the channels 27 have a "U"-shaped profile with wings 35 and a bottom 36.

The three channels 27 destined for being connected to the three supporting arms 23 are also equipped with a transversal septum 34 which closes the channel at the end to be inserted in the seat 31.

The fourth channel 27 destined for connection with the burner arm 24, on the other hand, has a free duct 29 to allow the entry of gas to the burner.

Flame-divider notches 30 are present along the sides of the wings 35.

The covers 11 and 12 are provided for the upper closing of the ducts, which can be seal-fixed by means of screws 15 to be screwed into specific holes 19 correspondingly situated in the framework 22.

Said covers 11, 12 have upper first and second wings 13 and 13', respectively, for supporting the cooking containers in a raised position with respect to the burner, the first wings 13 extend from the outer cover 11 whereas the second wings extend from the inner cover 12 to support smaller containers.

The outer cover 11 therefore corresponds to the framework 22, and has holes 14 corresponding to the holes 19 for fixing with screws 15.

The inner cover 12 corresponds to the second burner base 21, in particular it comprises four plates 17 radially extending from a central crown 16 configured so as to correspond to the radial channels 27 and the crown 26 of the second burner base, respectively.

The inner cover 12 also has an opening 18 corresponding to the aeration opening 28 of the second burner base.

In this way, the flame and combustion distribution is optimized and it is extremely easy to dismantle and clean the inner cover and burner base without having to intervene on the outer cover and framework.

The washing of the burner is much more practical with respect to conventional burners, as it is possible to effect said washing in dishwashers, for example, or with suitable solvents suitable for dissolving the crusting.

The burner according to the invention has advantageous variants.

Figure 1:
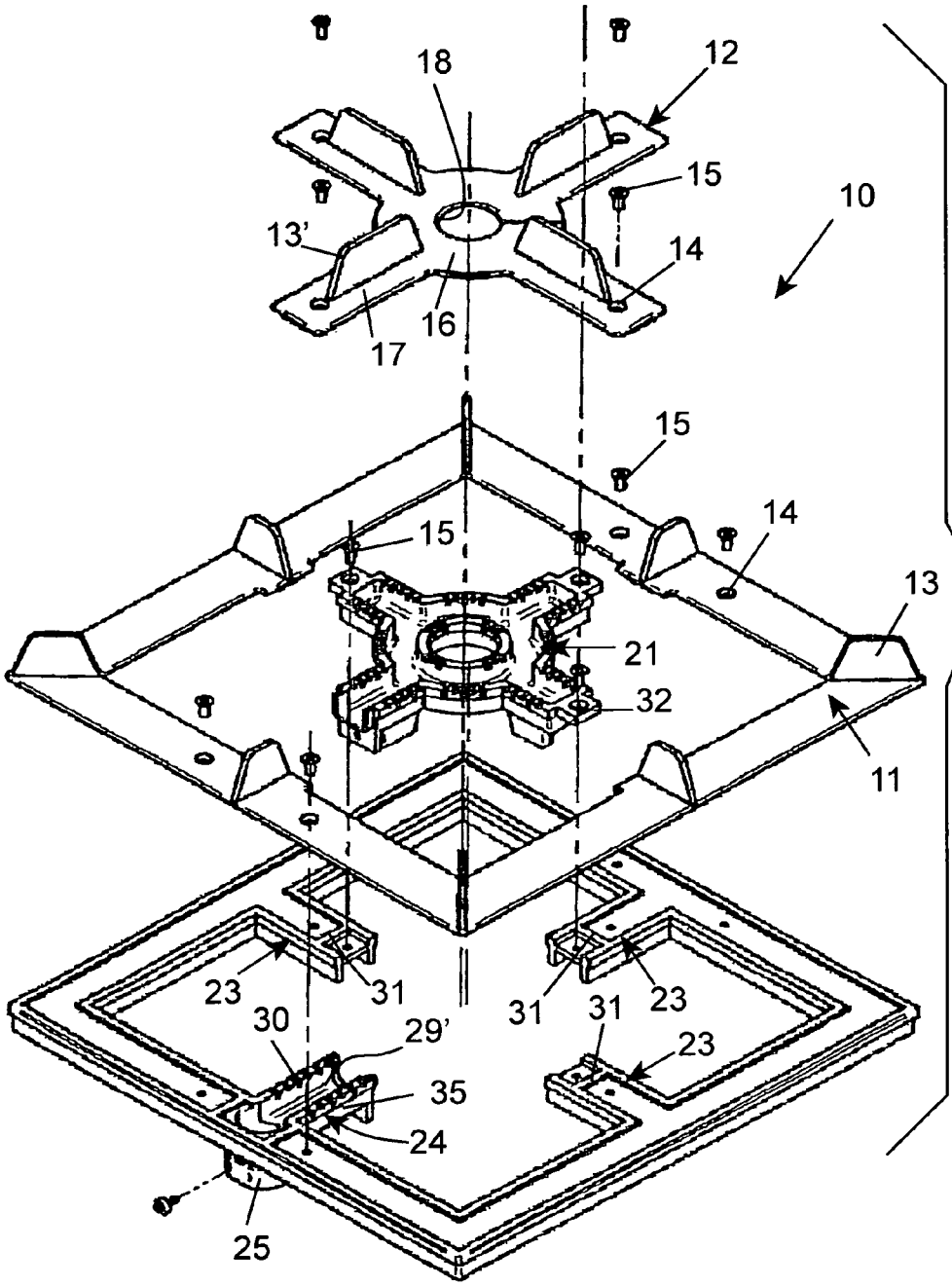
FIG. 1 is an exploded perspective view of a burner for cooking plates according to the present invention.
Figure 2:
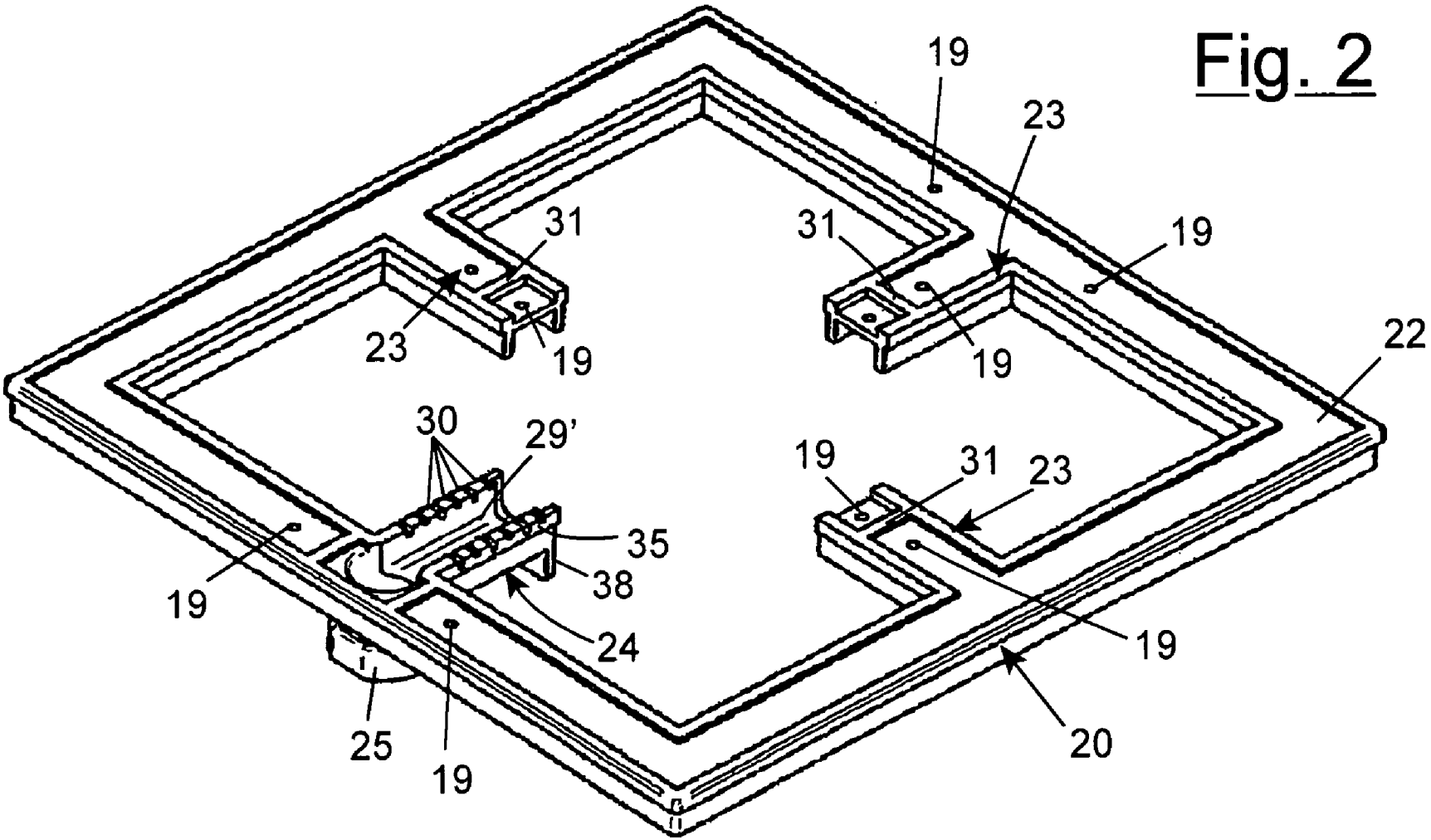
FIG. 2 is a perspective view of the base of the burner of FIG. 1.
Figure 3:
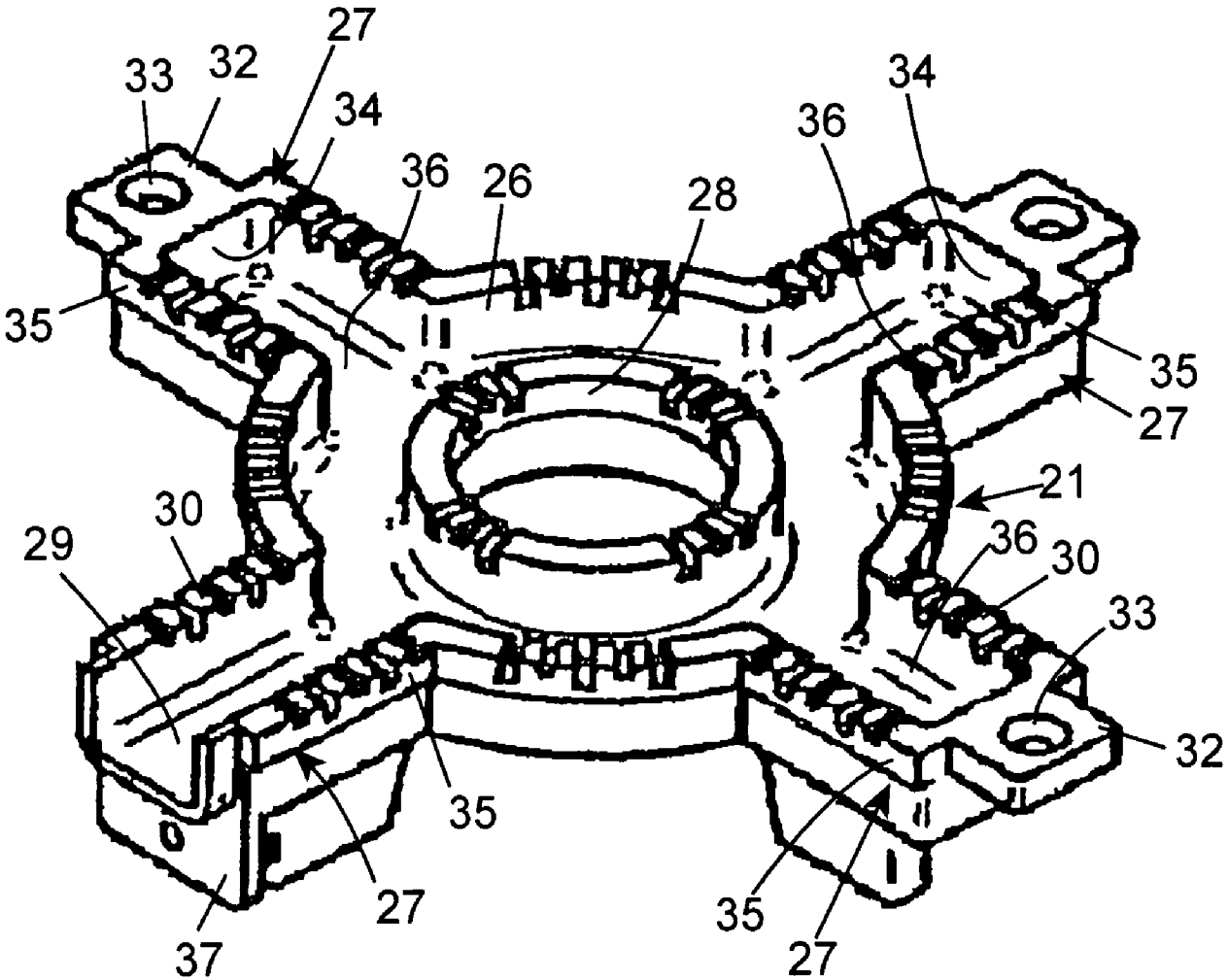
FIG. 3 is a perspective view of a portion of the burner of FIG. 1.
Figure 4:
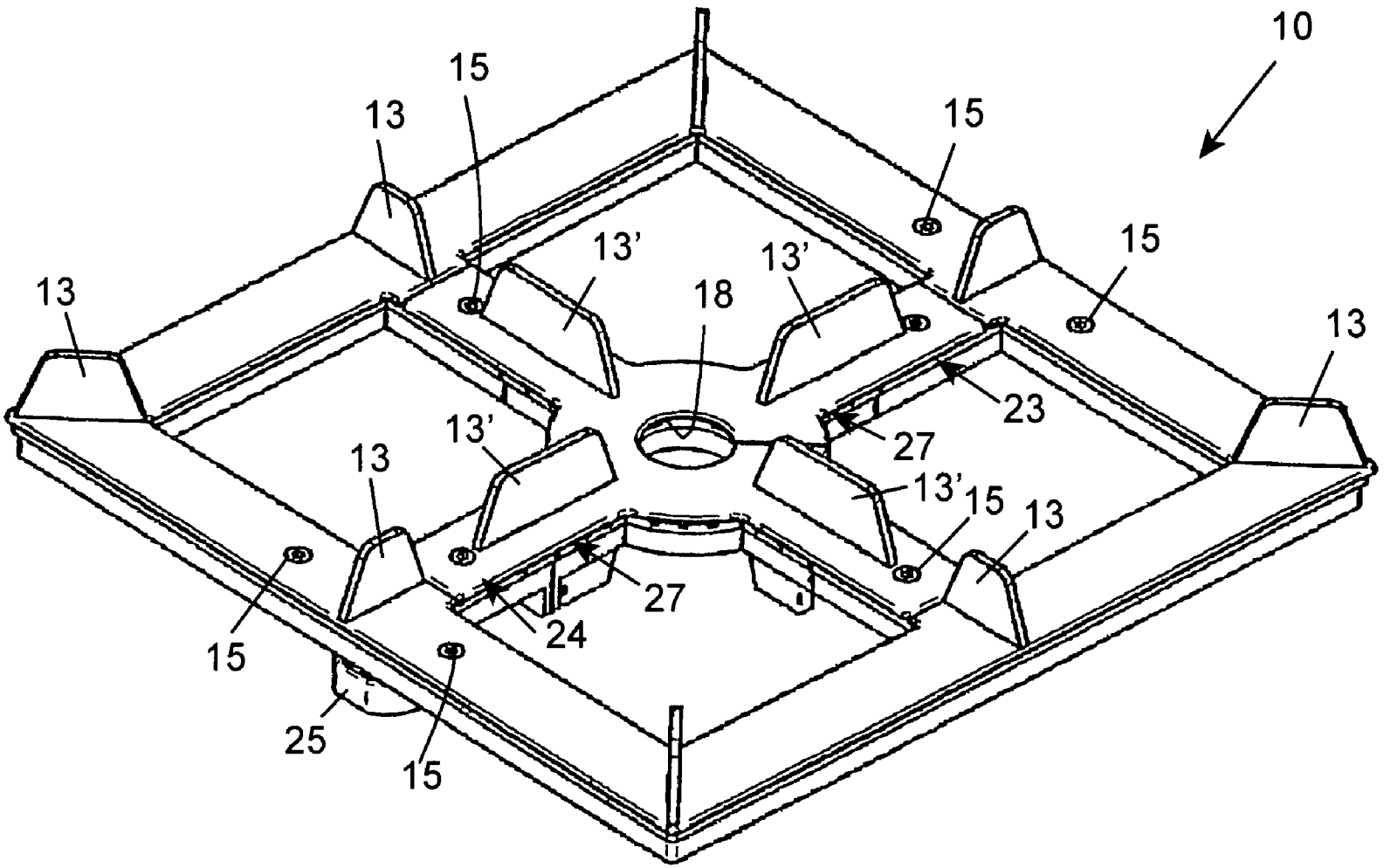
FIG. 4 is a perspective view of the burner according to the invention, assembled.
Figure 5:
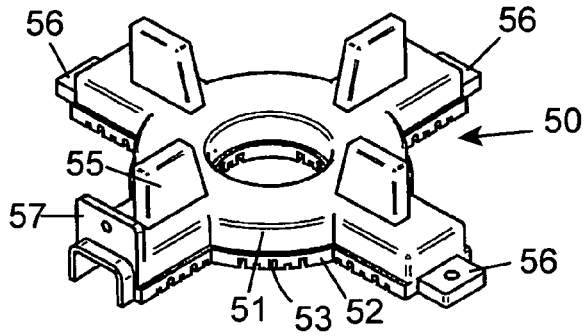
FIG. 5 is a perspective view of a different embodiment of a burner cover.

FIG. 5 illustrates a rounded cover 50 destined for covering the second burner base 21.

The cover is equipped with channels 51 equipped with flame-divider notches 53 along the lower edges 52.

Figure 6:
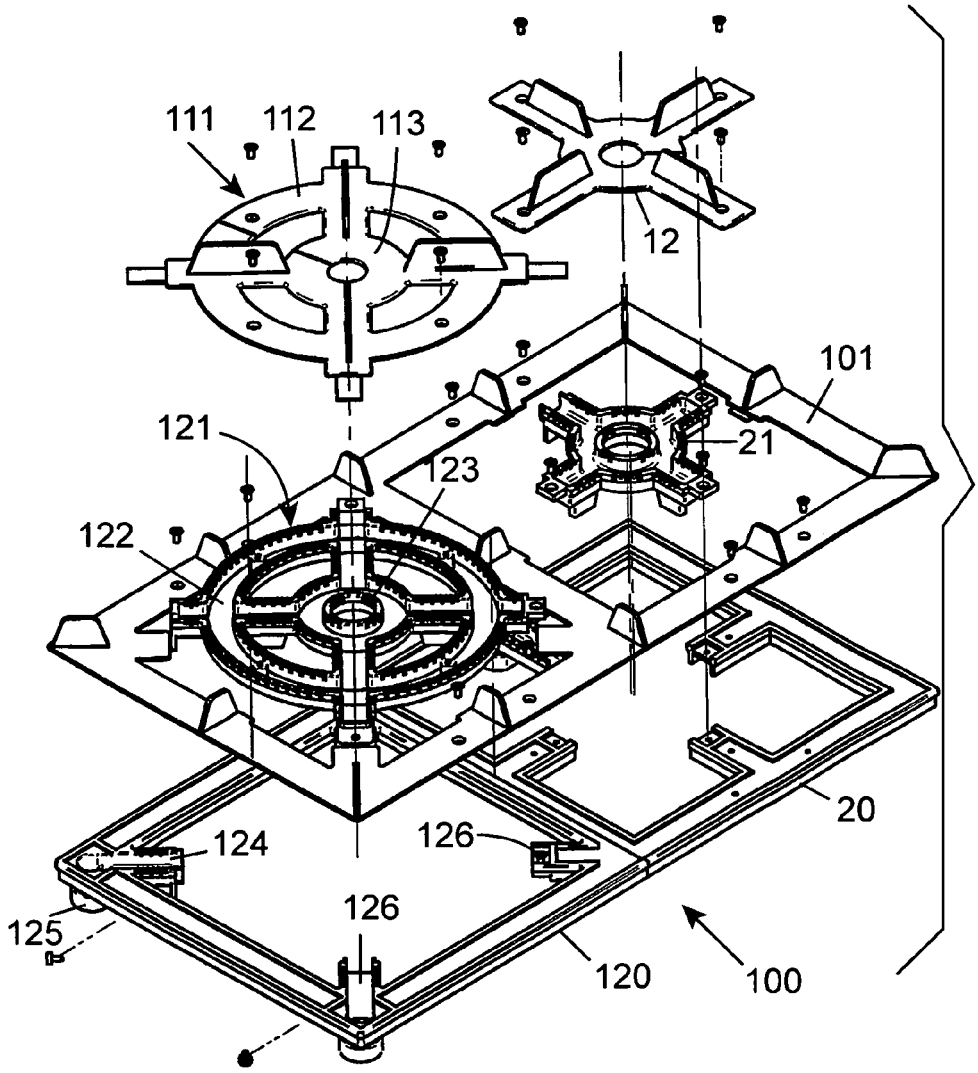
FIGS. 6-8 show a large-small double-flame burner according to the invention in an exploded perspective view and assembled in a perspective and plan view, respectively.
Figure 7:
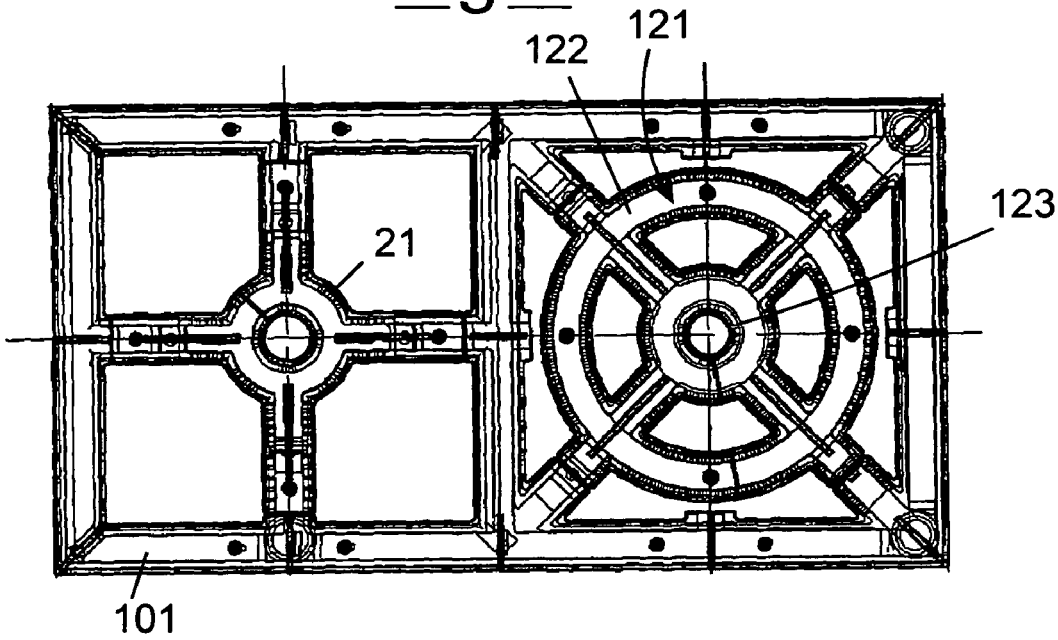
Figure 8:
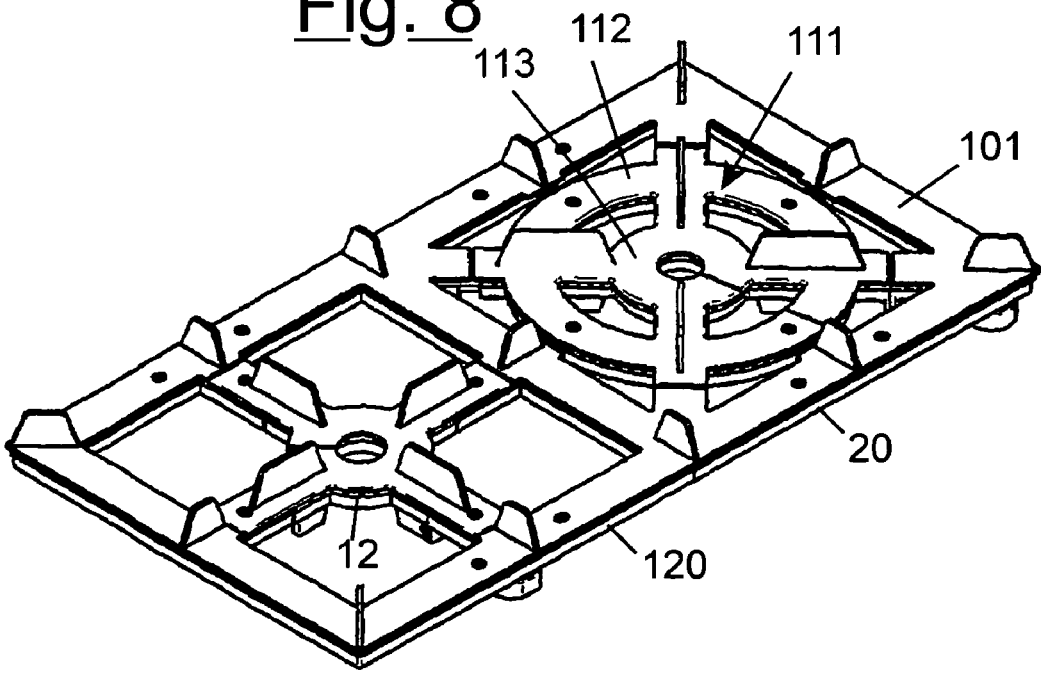
Figure 9:
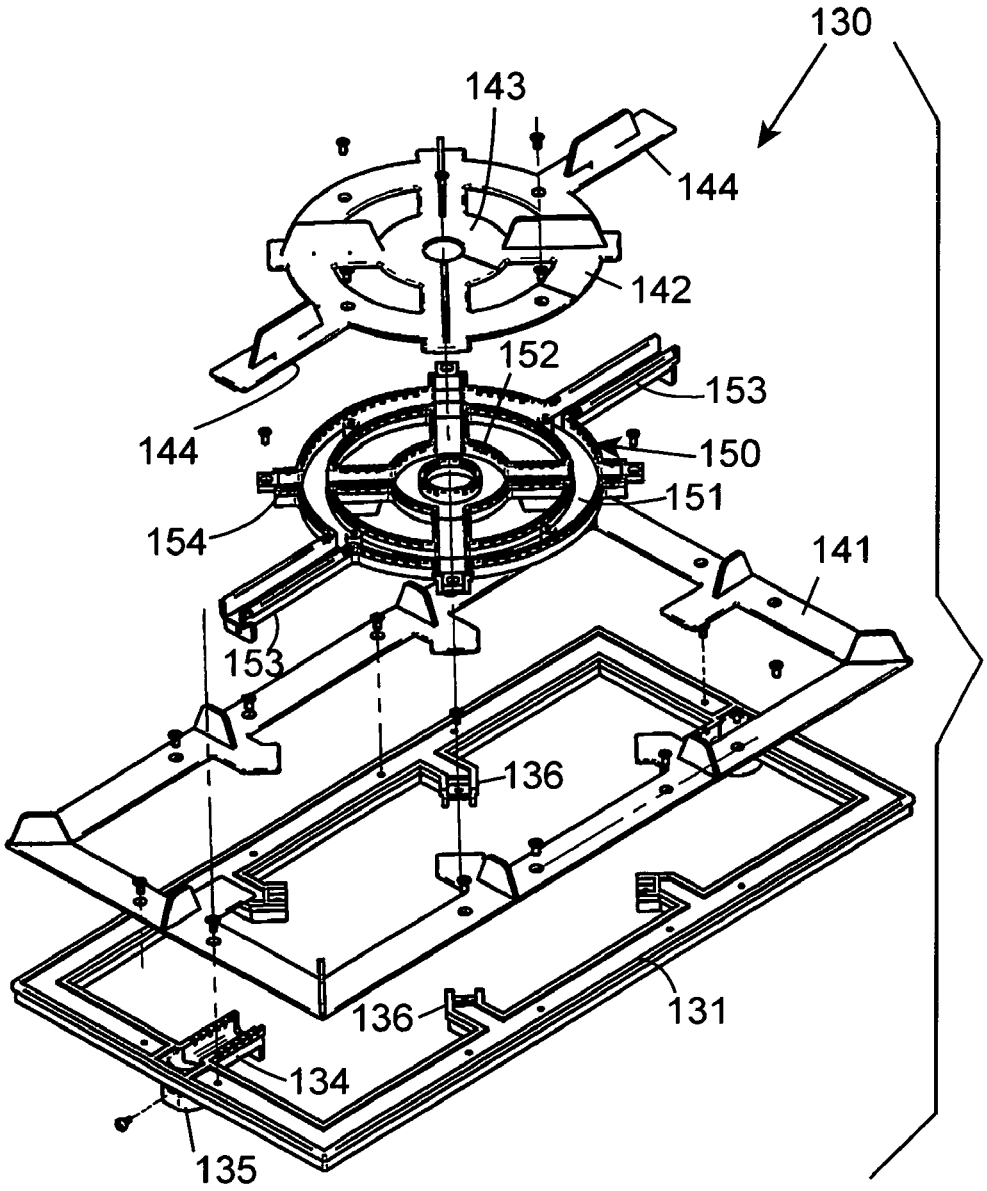
Figure 10:
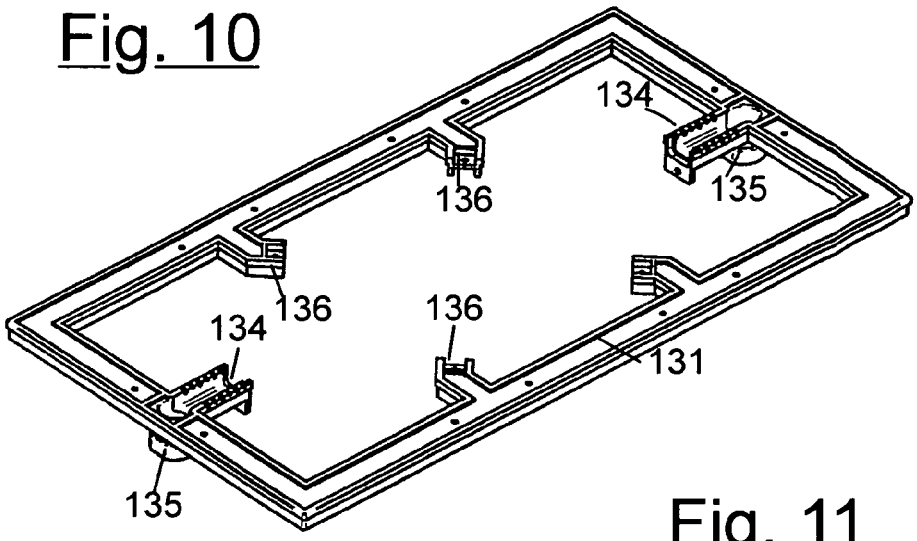
Figure 11:
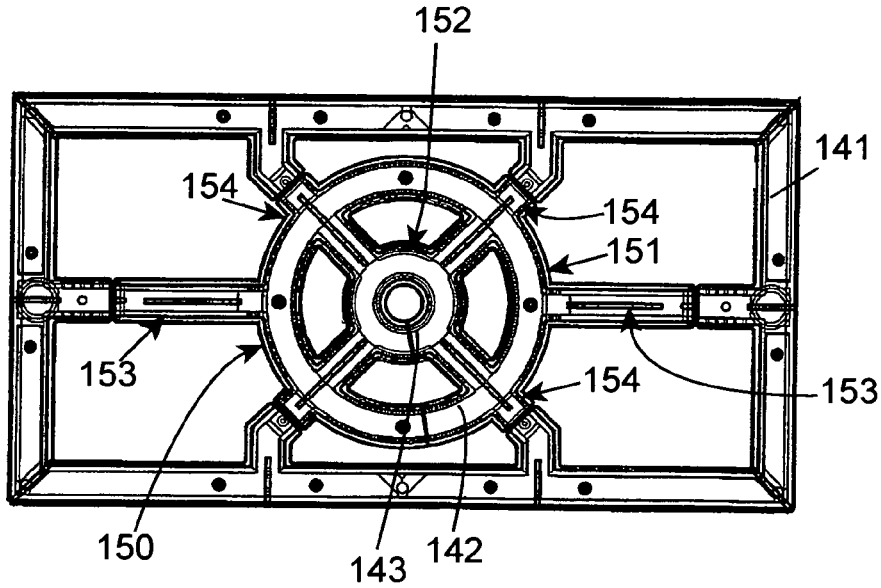
Figure 12:
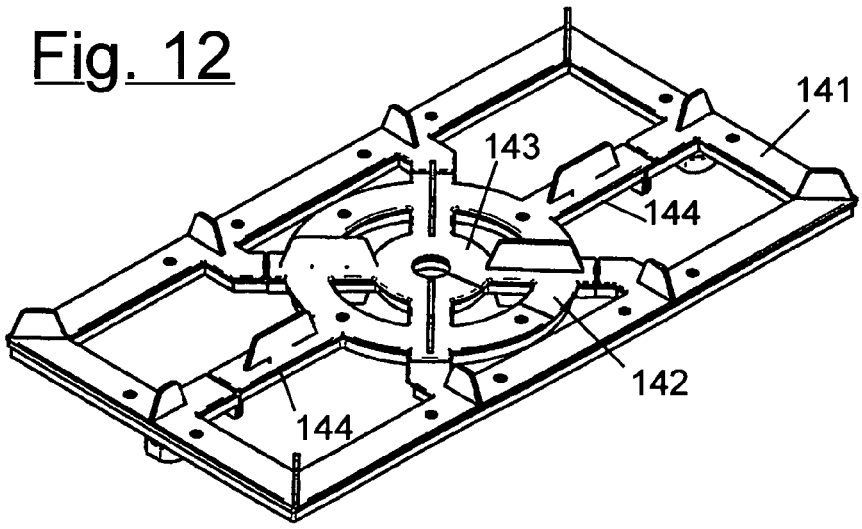

There are also wings 55 for supporting the cooking containers in a raised position with respect to the burner, brackets with a hole 56 destined for fixing to the corresponding brackets of the arms of the second burner base (21), and an upper counter-element 57 at the end of the channel which corresponds to the lower counter-element of each arm of the second burner base 56. FIGS. 6-8 illustrate a double burner 100 with a small flame and large flame.

The burner therefore comprises the first burner base 20 connected to a third burner base 120 destined for a burner with a double crown 121, destined for a fourth burner base with an outer crown 122 and an inner crown 123 connected to each other.

The third burner base 120 is equipped with supporting arms 126 and at least one burner arm 124 fed by a connection 125.

The cover 101 of the framework correspondingly has a double dimension for covering both of the frameworks of first burner base 20, and third burner base 120 whereas a cover 112 is envisaged of the double-crowned burner forming an outer crown 112 and an inner crown 113, whereas the small burner envisages the cover 56 described above.

FIGS. 9-12 illustrate a large-flame burner 130, consisting of a fourth burner base 131 correspondingly extended, preferably equipped with two opposite burner arms 134 each having its own feeding connection 135 and four supporting arms 136 arranged centrally.

The double-crowned burner base 150 has two opposite extended ducts 153 suitable for connection to the two burner arms 134 and four supporting arms 154 corresponding to the arms 136.

The fifth burner base has an outer crown 151 and an inner crown 152 connected for the gas circulation.

The fourth burner base 131 and burner crown are closed above by an outer perimetric cover 141 and a double-crowned cover having an outer crown 142 and inner crown 143 and two opposite extended plates 144 suitable for closing the extended ducts 153.

FIG. 13 illustrates another embodiment of a double small-small flame burner 200 in which a single double base 220 equipped with two burner arms 224 allows the assembly of two burners 21, the whole unit being closed above by an outer cover 211 and two inner covers 12 respectively.

With reference to FIGS. 14 and 15, these illustrate an oblong burner for a fish pan 250 consisting of a sixth burner base 251 correspondingly extended preferably equipped with two opposite burner arms 254 each having its own feeding connection 255 and six supporting arms 256 arranged centrally.

The seventh burner base 261 has an oblong crown 262 and two opposite extended ducts 264 suitable for connection to the two burner arms 254 and six supporting arms 263 corresponding to the base arms 256.

The sixth burner base 251 and burner 261 are respectively closed above by an outer perimetric cover 271 and an oblong cover having an oblong crown 273 and two opposite extended plates 272 suitable for closing the extended ducts 264.

FIGS. 16-18 illustrate different cooling plate compositions using the burners described above, and respectively:

a composition of two double small-flame side burners 200 with a central large-flame burner 130;

a composition of a double small-flame side burner 200 with a central oblong burner for a fish pan 250 and a double large-small flame side burner 100;

a composition of two double small-flame side burners 200 with a central oblong burner for a fish pan 250.

With reference to the present description and relative figures, it is evident how a modular burner for a cooking plate according to the invention is particularly useful and advantageous. The objective mentioned in the preamble of the description is therefore achieved.

The forms of the burner according to the invention can obviously be different from those shown for illustrative and non-limiting purposes in the drawings.

The protection scope of the invention is therefore delimited by the enclosed claims.

The invention claimed is:

1. A modular burner for a cooking plate of a cooking appliance, characterized in that it comprises a first burner base (20) in turn comprising a framework (22), a second burner base (21) which can be centrally assembled to the framework (22), an outer cover (11) and an inner cover (12) for covering the framework (22) and the second burner base (21) wherein said outer cover (11) and an inner cover (12) are separated and adapted for covering the framework (22) and the second burner base (21) respectively and said framework (22) comprises a series of supporting arms (23) which extend radially towards the center of the framework (22) and a burner arm (24) fed with gas from a connection (25) situated along the framework (22) wherein said framework (22) is square with four sides and has three supporting arms (23) extending from the center of three sides of the framework and a burner arm (24) extending from the center of a fourth side of said framework (22).

2. The modular burner according to claim 1, characterized in that said burner arm (24) is "U"-shaped with wings (35) and is equipped with a channel (291) connected to the connection (25) for the gas feeding to the whole of the burner base (21), said burner arm (24) also having flame-divider notches (30) situated along the edge of the wings (35) of the "U".

3. The modular burner according to claim 1, characterized in that the burner arm (24) has a lower bracket (38) suitable for being connected to a corresponding lower counter-element (37) extending from the burner base (21).

4. The modular burner according to claim 3, characterized in that at the end facing the inside of the framework, each supporting arm (23) has a seat (31) equipped with a hole (19) for housing the corresponding ends of the second burner base (21) and allowing it to be fixed by means of screws (15).

5. The modular burner according to claim 1, characterized in that said second burner base (21) is equipped with radial channels (27) configured so as to correspond to the arms (23, 24) to be supported by these and allow the circulation of the gas fed from a channel (29') connected to the connection (25).

6. The modular burner according to claim 5, characterized in that said second burner base (21) also comprises a crown (26) equipped with a central aeration opening (28), the channels (27) extending radially from said crown.

7. The modular burner according to claim 6, characterized in that three of the four channels (27) are each equipped at their own free end with a bracket (32) with a hole (33) adapted to receive one of the three arms (23), and the fourth channel (27) which is adapted to be connected to the burner arm (24).

8. The modular burner according to claim 7, characterized in that said crown (26) and said channels (27) have a "U"-shaped profile with wings (35) and a bottom (36), and having flame-divider notches (30) present along the edges of the wings (35).

9. The modular burner according to claim 7, characterized in that inner cover (11) and outer cover (12) are provided for the upper closure of the ducts which can be seal-fixed by means of screws (15) screwed into holes (19) which are correspondingly positioned in the framework (22).

10. The modular burner according to claim 9, characterized in that said inner cover (11) and outer cover (12) have first and second wings (13, 13') respectively for supporting cooking containers in a raised position with respect to the burner.

11. The modular burner according to claim 10, characterized in that said outer cover (11) is situated in correspondence with the framework (22), and has holes (14) corresponding to the holes (19) for fixing with screws (15).

12. The modular burner according to claim 10, characterized in that said inner cover (12) is situated in correspondence with the burner base (21), comprising four plates (17) radially extending from a central crown (16) configured so as to correspond with the radial channels (27) and crown (26) of the second burner base (21) respectively.

13. The modular burner according to claim 12, characterized in that said inner cover (12) also has an opening (18) corresponding to the aeration opening (28) of the second burner base (21).

14. The modular burner according to claim 1, characterized in that said burner comprises a rounded cover (50) destined for covering the second burner base (21).

15. The modular burner according to claim 1, characterized in that said burner is in the form of a double burner (100) with a small flame and a large flame, comprising the first base (20) connected to a third burner base (120) adapted for a double-crowned burner (121), destined for a burner base with an outer crown (122) and an inner crown (123) connected to each other, the third burner base (120) being equipped with supporting arms (126) and at least one burner arm (124) fed with gas by a connection (125), the cover (101) of the framework having a double dimension for covering the first burner base (20) and the third burner base (120) and having a cover (112) for the double-crowned burner which forms an outer crown (112) and an inner crown (113), and having a cover (12) for the small burner (21).

16. The modular burner according to claim 1, characterized in that said burner is a large-flame burner (130), produced with a correspondingly extended fourth base burner (131) preferably equipped with two opposite burner arms (134) each equipped with its own feeding connection (135) and four supporting arms (136) arranged centrally, the double-crowned fifth burner base (150) having two opposite extended ducts (153) connected to the two burner arms (134) and four supporting arms (154) corresponding to arms (136), the fifth burner base (150) having an outer crown (151) and an inner crown (152) connected a gas source, the fourth burner base (131) and burner crown are closed above by an outer perimetric cover (141) and a double-crowned cover having an outer crown (142) and an inner crown (143) and two opposite extended plates (144) suitable for closing the extended ducts (153).

17. The modular burner according to claim 1, characterized in that said burner is in the form of a double small-small flame burner (200) in which a single double base (220) equipped with two burner arms (224) allows the assembly of two burners (21), the whole unit being closed above by an outer cover (211) and two inner covers (12) respectively.

18. The modular burner according to claim 1, characterized in that said burner is in the form of an oblong burner for a fish pan (250) produced with a correspondingly extended sixth burner base (251) equipped with two opposite burner arms (254) each equipped with its own gas feeding connection (255) and six supporting arms (256) arranged centrally, the seventh burner base (261) has an oblong crown (262) and two opposite extended ducts (264) suitable for connection to the two burner arms (254) and six supporting arms (263) corresponding to the arms (256) of the sixth burner base (251) and the seventh burner base (261) are closed above by an outer oblong perimetric cover (271) having an oblong crown (273) and two opposite extended plates (272) suitable for closing the extended ducts (264).

19. A cooking plate according to claim 1 which comprises an additional burner.

20. A cooking plate according to claim 19, characterized in that it comprises two double small-flame side burners (200) with a central large-flame burner (130).

21. A cooking plate according to claim 19, characterized in that it comprises a double small-flame side burner (200) with a central oblong burner for a fish pan (250) and a double large-small flame side burner (100).

22. A cooking plate according to claim 19, characterized in that it comprises two double small-flame side burners (200) with a central oblong burner for a fish pan (250).

* * * * *